US007098766B2

(12) United States Patent
Gardner et al.

(10) Patent No.: US 7,098,766 B2
(45) Date of Patent: Aug. 29, 2006

(54) MAGNETIC MATERIAL FOR TRANSFORMERS AND/OR INDUCTORS

(75) Inventors: Donald S. Gardner, Mountain View, CA (US); Peter Hazucha, Beaverton, OR (US); Gerhard Schrom, Hillsboro, OR (US); Tanay Karnik, Portland, OR (US); Vivek K. De, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 27 days.

(21) Appl. No.: 10/760,591

(22) Filed: Jan. 21, 2004

(65) Prior Publication Data

US 2005/0156704 A1 Jul. 21, 2005

(51) Int. Cl.
*H01F 5/00* (2006.01)

(52) U.S. Cl. ..... 336/200

(58) Field of Classification Search ..... 336/65, 336/83, 178, 200, 206–208, 232; 257/531
See application file for complete search history.

(56) References Cited

U.S. PATENT DOCUMENTS

| | | | | |
|---|---|---|---|---|
| 5,138,393 | A * | 8/1992 | Okamura et al. | 335/297 |
| 2002/0008605 | A1 * | 1/2002 | Gardner | 336/200 |
| 2003/0001713 | A1 | 1/2003 | Gardne r | |

FOREIGN PATENT DOCUMENTS

| | | | |
|---|---|---|---|
| JP | 64-065889 | * | 3/1989 |
| JP | 03-212913 | * | 9/1991 |

* cited by examiner

*Primary Examiner*—Tuyen T Nguyen
(74) *Attorney, Agent, or Firm*—Fleshner & Kim, LLP

(57) ABSTRACT

A transformer is provided that includes a plurality of metal lines and a magnetic material provided about the plurality of metal lines. The magnetic material may include a structure to reduce Eddy currents flowing in the magnetic material. This structure may be a plurality of slots extending perpendicular to the metal lines. This structure may also be a laminated structure.

26 Claims, 7 Drawing Sheets

MAGNETIC MATERIAL FOR TRANSFORMERS AND/OR INDUCTORS

FIELD

Embodiments of the present invention may relate to transformers and inductors. More particularly, embodiments of the present invention may relate to transformers and inductors that may be integrated on a die.

BACKGROUND

Transformers may be used in many different types of power distribution systems, such as in voltage (or power) converters. Power converters may not be fully integrated on-chip for a variety of reasons. For example, power converters may be designed at 0.1 to 10 MHz operating frequencies. On-chip inductors may not be used because the amount of inductance needed for a circuit such as a Buck converter at these frequencies is large. Additionally, the physical size of inductors may be too large with certain magnetic materials. Still further, in high-frequency inductors, magnetic materials may not be used because their frequency range has been limited to less than 100 MHz.

There are advantages to integrating a power distribution system on the same die as the circuits that are powered by the power distribution system. For example, as processor technology scales to smaller dimensions, supply voltages to circuits within a processor may also scale to smaller values. But for many processors, power consumption has also been increasing as technology progresses. Using an off-die voltage converter to provide a small supply voltage to a processor with a large power consumption may lead to a large total electrical current being supplied to the processor. This may increase the electrical current per pin, or the total number of pins needed. Also, an increase in supply current may lead to an increase in resistivity as well as inductive voltage drop across various off-die and on-die interconnects, and to a higher cost for decoupling capacitors. Integrating the voltage (or power) converter onto the die may mitigate these problems.

BRIEF DESCRIPTION OF THE DRAWINGS

The foregoing and a better understanding of the present invention will become apparent from the following detailed description of arrangements and example embodiments (and the claims) when read in connection with the accompanying drawings, all forming a part of the disclosure of this invention. While the foregoing and following written and illustrated disclosure focuses on disclosing arrangements and example embodiments of the invention, it should be clearly understood that the same is by way of illustration and example only and the invention is not limited thereto.

The following represents brief descriptions of the drawings in which like reference numerals represent like elements and wherein.

DETAILED DESCRIPTION

Figure 1:
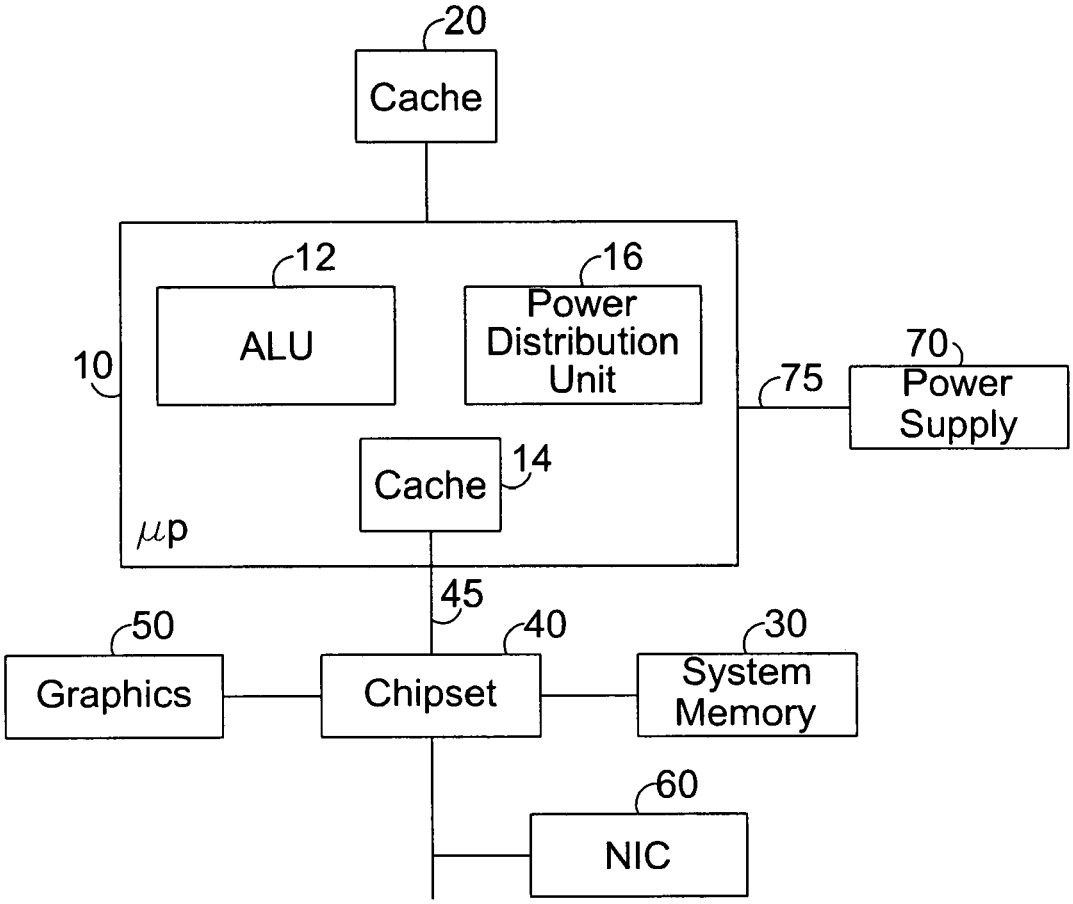
FIG. 1 is a block diagram of a computer system according to an example arrangement.

In the following detailed description, like reference numerals and characters may be used to designate identical, corresponding or similar components in differing figure drawings. Further, in the detailed description to follow, example sizes/models/values/ranges may be given although the present invention is not limited to the same. Where specific details are set forth in order to describe example embodiments of the invention, it should be apparent to one skilled in the art that the invention can be practiced without these specific details.

As will be described below, embodiments of the present invention may provide a transformer (or power converter) that includes magnetic material about a plurality of metal lines. The magnetic material may include a structure to reduce Eddy currents flowing in the surrounding magnetic material. This structure may be a plurality of slots extending perpendicular to the metal lines. The slots may create gaps that may be filled with an insulation material to prevent current from flowing, and thereby reducing the Eddy current. The structure may also be a laminated magnetic structure that includes thinner layers such that it is harder for electrons to flow (i.e., a higher resistance). This higher resistance may result in less Eddy current.

FIG. 1 is a block diagram of a computer system according to an example arrangement. Other arrangements are also possible. More specifically, FIG. 1 shows a microprocessor die 10 having a plurality of sub-blocks, such as arithmetic logic unit (ALU) 12, an on-die cache 14 and a power distribution unit 16. The microprocessor 10 may also communicate to other levels of cache, such as an off-die cache 20. Higher memory hierarchy levels, such as a system memory 30, may be accessed via a chipset 40 and a host bus 45. In addition, other off-die functional units, such as a graphics accelerator 50 and a network interface controller (NIC) 60, to name just a few, may communicate with the microprocessor 10 via appropriate busses or ports.

A power supply 70 may provide an input supply voltage to the on-die power distribution unit 16 via a power bus 75. The power supply 70 may provide power to other modules, but for ease of illustration such connections are not shown in FIG. 1. Transformers, as will be described below, may be utilized in the on-die power distribution unit 16, such as to convert high voltages to lower voltages.

For a transformer to be small enough to be integrated on a die, its operating frequency for example, the frequency of a controller needs to be sufficiently high. Additionally, magnetic material suitable for high frequency operation may be used to increase coupling between windings of the transformer. The magnetic material may be one of amorphous CoZrTa, CoFeHfO, CoAlO, FeSiO, CoFeAlO, CoNbTa, CoZr, and other amorphous cobalt alloys, for example. An amorphous alloy may include various atomic percentages of its constituent elements. For example, the amorphous cobalt alloy CoZrTa may have 4% Zr, 4.5% Ta, with the remainder being Co. For CoZrTa, the range for Zr may be from 3% to 12% and the range for Ta may be from 0% to 10%. The cobalt alloy CoFeHfO may have 19% Fe, 14% Hf, and 22% O, or the Cobalt alloy CoFeAlO may have 51% Co, 22% Fe, and 27% Al. These values are merely examples as other examples and values are also possible. The use of such magnetic material may allow for operating frequencies of 10 MHz to 1 GHz, and higher. Other magnetic materials may also be used.

Figure 2:
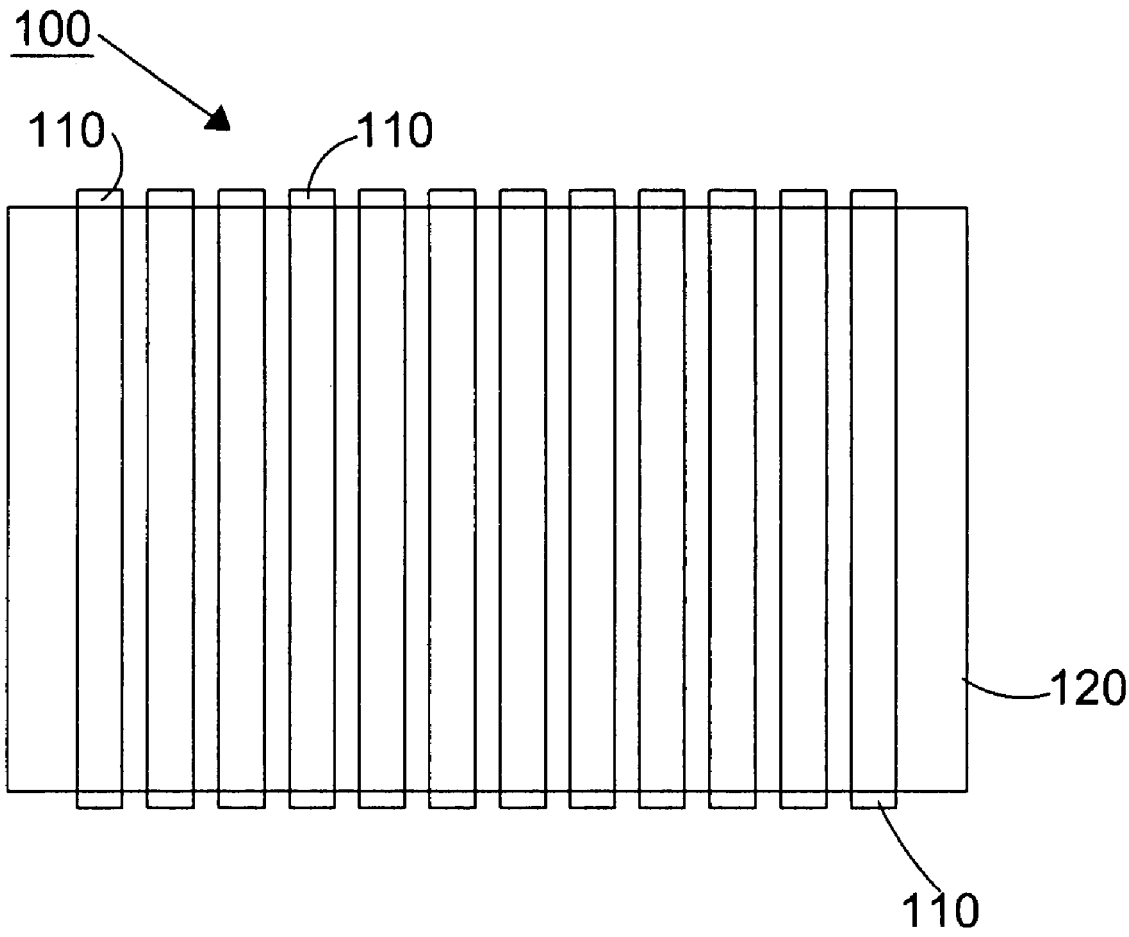
FIG. 2 is a top view of a transformer according to an example arrangement.

FIG. 2 is a top view of a transformer according to an example arrangement. Other arrangements are also possible. More specifically, FIG. 2 shows a simplified top view of a transformer 100 integrated on a die. The transformer 100 may include metal lines (conductors) 110 formed parallel to each other by standard silicon processing techniques. Magnetic material 120 may be deposited above and below the parallel metal lines 110, and around the leftmost and rightmost parallel metal lines 110 to form a closed magnetic circuit and so as to provide a large inductance and magnetic coupling among the metal lines 110. This increases the magnetic coupling between the windings of the transformer 100 for a given size of the transformer 100. For simplicity, FIG. 2 shows the magnetic material 120 only above the metal lines 110 although the magnetic material may also be below and on the sides of the metal lines 110.

Figure 3:
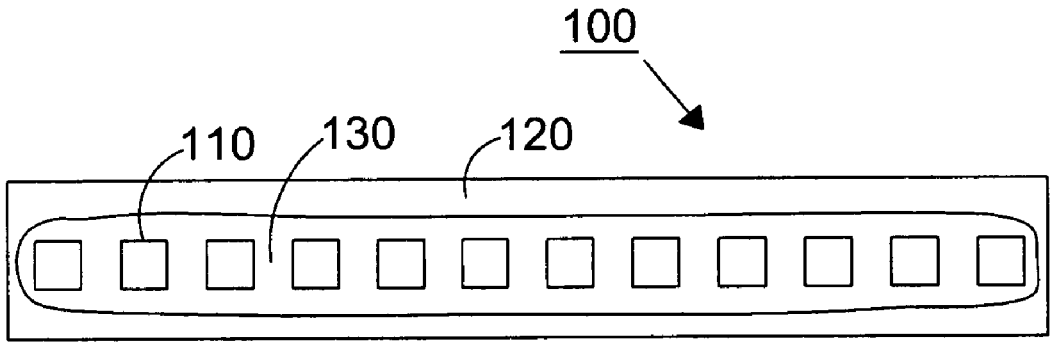
FIG. 3 is a side view of the transformer shown in FIG. 2.

FIG. 3 is a side view of the transformer 100 of FIG. 2 according to an example arrangement. Other arrangements are also possible. More specifically, FIG.3 shows that the metal lines 110 are insulated from each other and from the magnetic material 120 by an insulating material 130, which may be $SiO_2$, for example. As discussed above, the magnetic material 120 may be deposited both below and above the metal lines 110, as well as around the leftmost and rightmost metal lines. Although not shown in FIG. 3, a small gap may be fabricated between the top and bottom magnetic layers. The gap may be formed in the magnetic material 120 near the rightmost (with respect to the perspective view) line so that magnetic material 120 does not completely surround the metal lines 110. The gap may also be formed in the magnetic material 120 near both the leftmost and rightmost lines. This may result in a higher saturation current.

The insulating material 130 deposited around the metal lines 110, and in any end gap in the magnetic material 120 if present, may have a smaller magnetic permeability than that of the magnetic material 120. Otherwise, the magnetic coupling between the metal lines 110 may degrade. For example, the relative permeability of the magnetic material 120 may be greater than 100 and the relative permeability of the insulating material 130 may be close to one.

Forming metal lines 110 within one layer, as shown in FIG. 3, may reduce the number of metal levels needed, and may reduce capacitance between the metal lines 110 when compared to forming metal lines on top of each other.

For ease of illustration, FIGS. 2 and 3 only shows twelve parallel metal lines, and do not show the die substrate, other layers, and interconnects. Other numbers of metal lines and features are also possible.

Embodiments of the present invention may provide a magnetic film (or magnetic material) around metal lines of a transformer (or power converter). The magnetic material may be made with slots and/or laminations (i.e. a laminated structure). This magnetic material may limit Eddy currents flowing in the magnetic material. More specifically, a microstructure may be provided that includes metal lines surrounded with magnetic material such as amorphous CoZrTa for use as a micro-transformer or micro-inductor on a chip. The structure may be prepared by patterning a plurality of metal lines next to each other that are wide so as to lower the electrical resistance. The metal lines may then be surrounded with the magnetic material. In order to reduce the Eddy currents flowing in the magnetic films, the magnetic material may be made with slots and/or laminations to limit the Eddy currents. As one example, the slots may be formed perpendicular (or substantially perpendicular) to the lengths of the metal lines. The slots therefore may extend perpendicularly (or substantially perpendicularly) to the flow of current in the metal lines. A laminated structure may be formed (or provided) in the magnetic material by adding insulation material between layers of CoZrTa including Co oxide prepared using an oxygen plasma.

Embodiments of the present invention may fabricate a power converting circuit with micro-transformers that are monolithically integrated onto a chip (or die) to convert high voltages (such as 2 volts) to lower voltages (such as 0.7 volts) and thereby reduce the pin count of the chip. The structure may include alternating wide lines deposited next to each other so as to reduce the number of metal levels necessary, while maintaining the resistance low and the capacitance under control. When wide lines are placed next to each other, the mutual inductance may be significantly lower than the self-inductance because of the widths, but by breaking up the wide line into separate narrower lines results in significantly higher mutual inductance. That is, the wide line may be broken up into many segments (such as 12 segments as discussed above) that are connected together at each end to increase the coupling coefficient and mutual inductance. As will be described below with respect to FIG. 4, slots may be provided within the magnetic material (or film) to reduce the Eddy currents. The slots may be perpendicular to the flow of current in the wide lines such that the slots do not interfere with the magnetic flux, but rather block (or reduce) the flow of Eddy currents. The magnetic material may be a thick amorphous CoZrTa surrounding the wide lines to improve the coupling between the sides of the transformer. As will be described below with respect to FIG. 5, an insulating layer (or material) may be provided between layers (or portions) of the magnetic material to reduce (or further reduce) the Eddy currents by effectively increasing the resistance of the magnetic material. The insulating layer may be provided by exposing the Co based magnetic material to an oxygen plasma to thereby form a thin oxide that can be easily patterned in the Co alloy patterning process.

Figure 4:
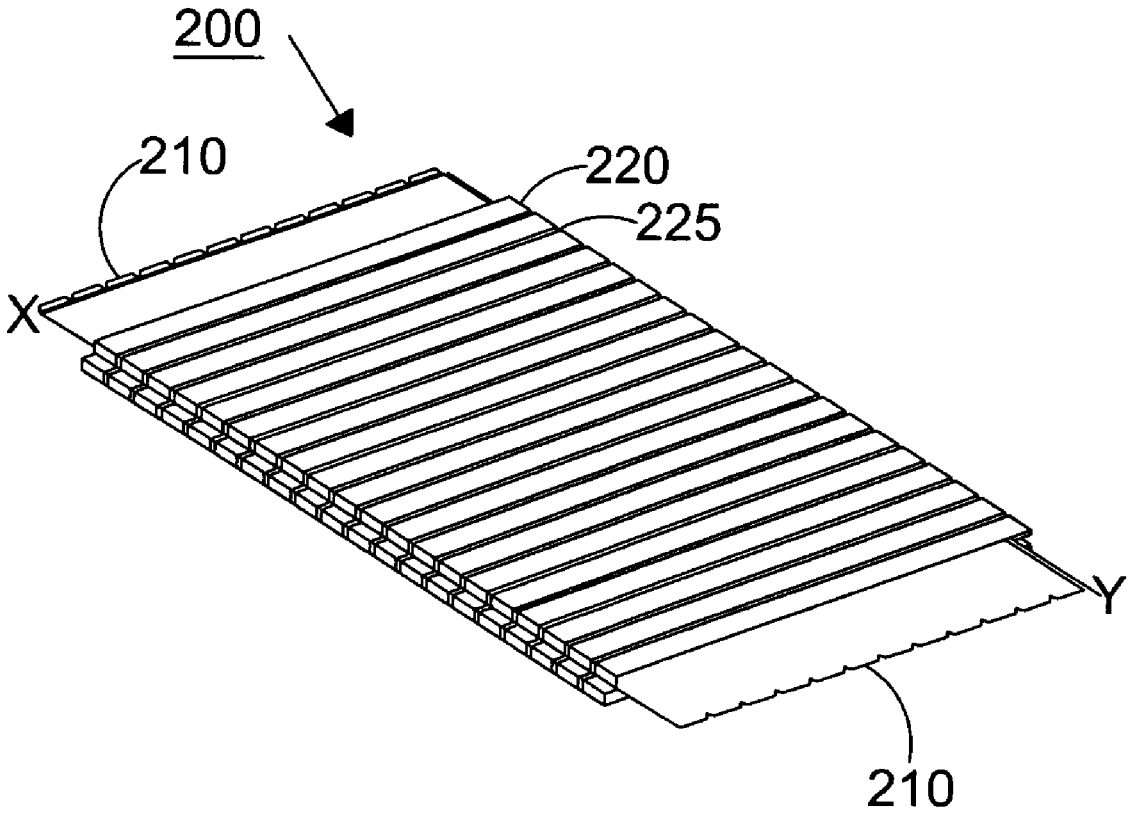
FIG. 4 is a view of a micro-transformer according to an example embodiment of the present invention.

FIG. 4 is a view of a micro-transformer according to an example embodiment of the present invention. The micro-transformer shown in FIG. 4 may correspond to the on-die power distributing unit 16 shown in FIG. 1. Other embodiments and configurations are also within the scope of the present invention. More specifically, FIG. 4 shows a micro-transformer 200 that includes a plurality of metal lines 210 formed parallel (or substantially parallel) to each other by standard silicon processing techniques. Magnetic material 220 may be deposited above and below the parallel metal lines 210. The metal lines 210 may be insulated from each other and from the magnetic material 220 by an insulating material such as $SiO_2$.

The magnetic material 220 may include a plurality of slots 225 formed perpendicular to the metal lines 210. The slots 225 may also be perpendicular (or substantially perpendicular) to the flow of current in the metal lines 210 such that the slots 225 do not interfere with the magnetic flux, but rather block (or substantially block) the flow of Eddy currents. Although not shown specifically in FIG. 4, the slots 225 may be formed on the top, bottom and sides of the magnetic material 220. The slots may be formed at the same time as during the patterning and etching process for the magnetic material.

Figure 5:
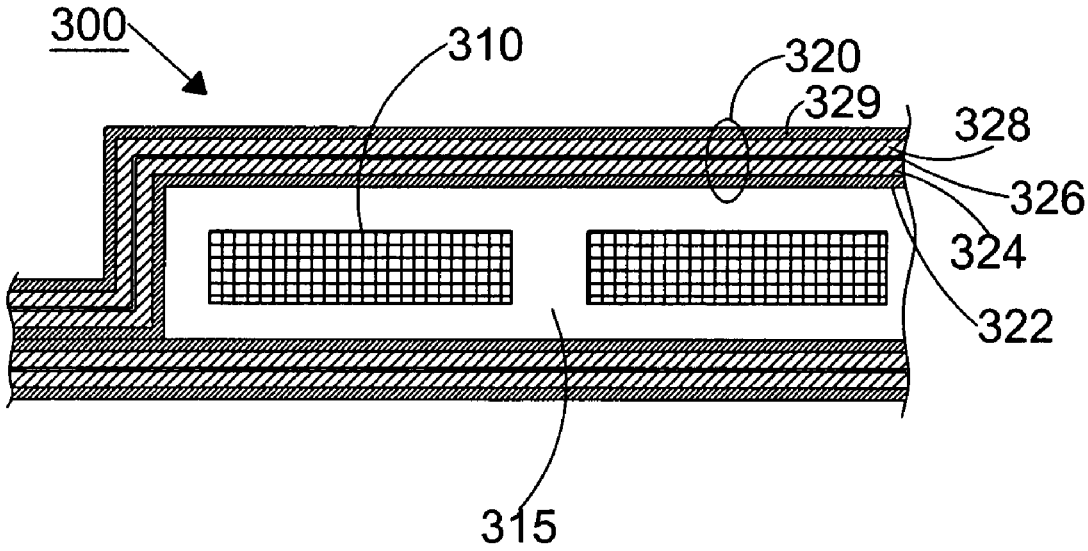
FIG. 5 is a side view of a micro-transformer according to an example embodiment of the present invention.

FIG. 5 is a side view of a micro-transformer according to an example embodiment of the present invention. The micro-transformer shown in FIG. 5 may correspond to the on-die power distributing unit 16 shown in FIG. 1. Other embodiments and configurations are also within the scope of the present invention. More specifically, FIG. 5 shows a micro-transformer 300 that may include a plurality of metal lines 310 formed parallel (or substantially parallel) to each other by standard silicon processing techniques. Magnetic material may be deposited above and below the parallel metal lines 310. The metal lines 310 may be insulated from each other and from the magnetic material by an insulating material 315 such as $SiO_2$. After the deposition, the insulating layer 315 may be chemical-mechanical polished (CMP) to planarize the surface before depositing the metal lines. In addition, CMP may be used to planarize the insulating layer before deposition of magnetic material. The insulating material 315 may be deposited in two separate processes. For example, the insulating material 315 may be first deposited below the area of the metal lines 310. Subsequently, the insulating material 315 may be deposited on the sides and top of the deposited metal lines 310.

The magnetic material may be a laminated structure 320 formed over the metal lines 310. For example, the laminated magnetic material 320 may include a stack of magnetic layers 322, 324, 328 and 329 and an insulation layer 326 between magnetic layers 324 and 328. The insulation layer 326 may be provided between layers of CoZrTa 324 and 328, for example. The insulation layer 326 may include an oxide or nitride such as a Co oxide prepared using an oxygen plasma. Other numbers of layers and materials are also within the scope of the present invention. The thickness of the magnetic layers can be 100~200 nm and the insulating layer 10~100 nm. The magnetic films may be deposited using sputtering, electroplating, or chemical vapor deposition.

Figure 6:
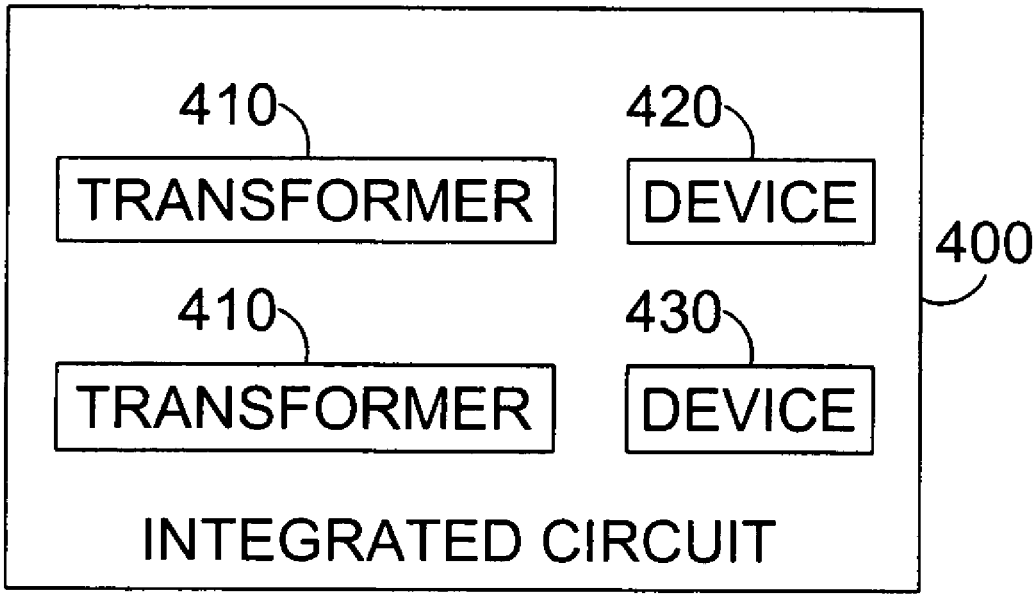
FIG. 6 is a block diagram of an integrated circuit according to an example embodiment of the present invention.

FIG. 6 is a block diagram of an integrated circuit according to an example embodiment of the present invention. Other embodiments and configurations are also within the scope of the present invention. More specifically, FIG. 6 shows that one or more transformers 410 may be integrated in an integrated circuit 400 with any suitable one or more integrated circuit devices, such as integrated circuit devices 420 and 430, for example, or with any suitable circuits comprising one or more integrated circuit devices, such as integrated circuit devices 420 and 430, for example. Each transformer 410 may be fabricated or provided similar as discussed above. Although illustrated as having two transformers 410, the integrated circuit 400 may be fabricated with any suitable number of one or more transformers 410.

Figure 7:
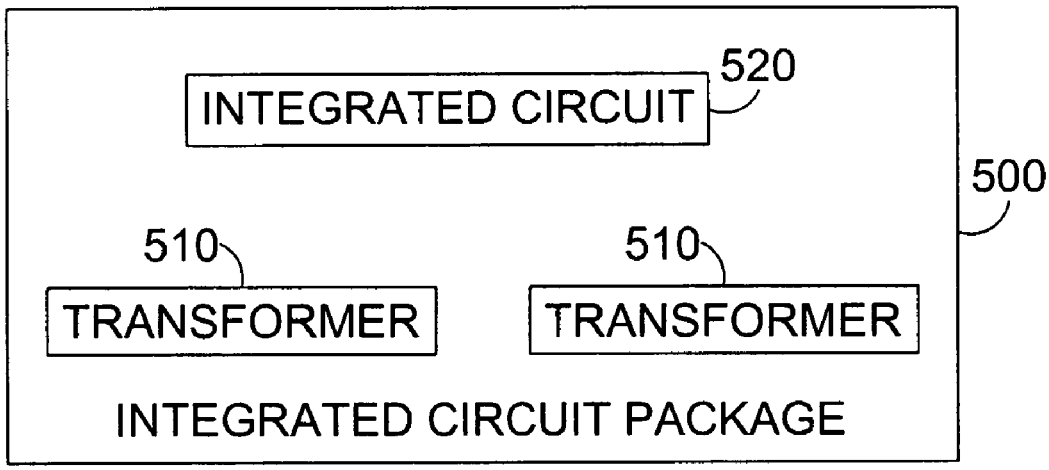
FIG. 7 is a block diagram of an integrated circuit package according to an example embodiment of the present invention.

FIG. 7 is a block diagram of an integrated circuit package according to an example embodiment of the present invention. Other embodiments and configurations are also within the scope of the present invention. More specifically, FIG. 7 shows that one or more integrated transformers 510 may be mounted in an integrated circuit package 500 for conductive coupling to an integrated circuit 520 housed by the integrated circuit package 500. Each transformer 510 may be fabricated or provided as discussed above. Although illustrated as having two transformers 510, the integrated circuit package 500 may be fabricated with any suitable number of one or more transformers 510.

Fabricating a power converter onto a chip with an integrated microtransformer may significantly reduce the cost associated with incorporating a power converter and may also reduce a socket pin count. Additionally, the number of socket pins may scale with the processor current. There may be fewer pins as compared to a circuit with a single scaled voltage. The motherboard resistance under the socket may also scale because a larger socket (i.e., more pins) may lead to a larger area under the motherboard.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments of the present invention have been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

What is claimed is:

1. A transformer comprising:

a plurality of parallel metal lines; and a magnetic material provided about the plurality of parallel metal lines, the magnetic material including a structure to reduce Eddy currents flowing in the magnetic material, the structure including a plurality of parallel slots provided in the magnetic material, the plurality of parallel slots extending substantially perpendicular to the plurality of parallel metal lines.

2. The transformer of claim 1, wherein the structure further includes a laminated magnetic structure that includes layers of magnetic material and insulation material.

3. The transformer of claim 2, wherein the insulation material comprises one of an oxide and a nitride.

4. The transformer of claim 2, wherein the insulation material comprises one of a cobalt oxide, a cobalt nitride and a cobalt oxynitride.

5. The transformer of claim 2, wherein the magnetic material is chosen from the group consisting of amorphous CoZrTa, CoFeHfO, CoAlO, FeSiO, CoFeAlO, CoNbTa, CoZr, and other amorphous cobalt alloys.

6. The transformer of claim 1, further comprising insulative material formed between the plurality of parallel metal lines and the magnetic material.

7. The transformer of claim 1, wherein the plurality of parallel metal lines extend along a first direction and the slots extend along a second direction, the second direction being substantially perpendicular to the first direction.

8. The transformer of claim 1, further comprising insulation material provided in the plurality of parallel slots.

9. The transformer of claim 1, further comprising insulating material to insulate each of the parallel metal lines from one another.

10. The transformer of claim 9, wherein the insulating material further insulates the parallel metal lines from the magnetic material.

11. The transformer of claim 1, wherein the parallel slots are formed on a top and a bottom of the magnetic material.

12. The transformer of claim 11, wherein the parallel slots are further formed on a side of the magnetic material.

13. The transformer of claim 1, wherein the plurality of parallel metal lines extend from a first end to a second end, the metal lines at the first end coupled together and the metal lines at the second end coupled together.

14. The transformer of claim 1, wherein the plurality of parallel metal lines extend from a first end to a second end, the metal lines at the first end coupled together and the metal lines at the second end coupled together to increase coupling coefficient and material inductance.

15. The transformer of claim 1, wherein the plurality of parallel metal lines and the magnetic material are provided on a die.

16. A transformer comprising:

a plurality of parallel metal lines of the transformer; and a magnetic material provided about the plurality of parallel metal lines, the magnetic material including a structure to reduce Eddy currents flowing in the magnetic material, the structure including a laminated magnetic structure having layers of magnetic material and insulation material.

17. The transformer of claim 16, wherein the insulation material comprises one of an oxide and a nitride.

18. The transformer of claim 16, wherein the insulation material comprises one of a cobalt oxide, a cobalt nitride and a cobalt oxynitride.

19. The transformer of claim 16, wherein the magnetic material is chosen from the group consisting of amorphous CoZrTa, CoFeHfO, CoAlO, FeSiO, CoFeAlO, CoNbTa, CoZr, and other amorphous cobalt alloys.

20. The transformer of claim 16, wherein the structure to reduce Eddy currents further includes a plurality of parallel slots provided in the magnetic material.

21. The transformer of claim 20, wherein the parallel slots extend substantially perpendicular to the plurality of parallel metal lines.

22. The transformer of claim 16, wherein the plurality of parallel metal lines and the magnetic material are provided on a die.

23. A transformer comprising:

a plurality of metal lines of the transformer formed substantially parallel to each other;

insulative material to surround the plurality of metal lines;

magnetic material to surround the plurality of metal lines; and a plurality of slots formed on the magnetic material, the slots formed substantially perpendicular to the plurality of metal lines of the transformer.

24. The transformer of claim 23, further comprising insulation material provided in the plurality of slots.

25. The transformer of claim 23, wherein the plurality of metal lines extend from a first end to a second end of the transformer, the metal lines at the first end coupled together and the metal lines at the second end coupled together.

26. The transformer of claim 23, wherein the slots to reduce Eddy currents in the magnetic material.

* * * * *